US010231506B2

(12) United States Patent
Chenciner

(10) Patent No.: US 10,231,506 B2
(45) **Date of Patent: *Mar. 19, 2019**

(54) THREE TOED FOOTWEAR

(71) Applicant: S9, LLC, Fort Myers, FL (US)

(72) Inventor: John M. Chenciner, Sanibel, FL (US)

(73) Assignee: S9, LLC, Bonita Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/614,645

(22) Filed: Feb. 5, 2015

(65) Prior Publication Data

US 2015/0143718 A1 May 28, 2015

Related U.S. Application Data

(63) Continuation of application No. 13/372,414, filed on Feb. 13, 2012, now Pat. No. 8,991,075, which is a (Continued)

(51) Int. Cl.

| | |
|---|---|
| ***A43B 7/14*** | (2006.01) |
| ***A43B 3/00*** | (2006.01) |
| ***A43B 7/26*** | (2006.01) |
| ***A43B 13/04*** | (2006.01) |
| ***A43B 13/14*** | (2006.01) |
| ***A43C 11/00*** | (2006.01) |
| ***A43C 11/14*** | (2006.01) |
| ***A43C 1/06*** | (2006.01) |

(52) U.S. Cl.

CPC ..... *A43B 3/0036* (2013.01); *A43B 7/145* (2013.01); *A43B 7/26* (2013.01); *A43B 13/04* (2013.01); *A43B 13/14* (2013.01); *A43C 1/06* (2013.01); *A43C 11/006* (2013.01); *A43C 11/1493* (2013.01)

(58) Field of Classification Search

CPC ..... A43B 3/0036; A43B 7/145; A43B 7/26; A43B 13/04; A43B 13/14

See application file for complete search history.

(56) References Cited

U.S. PATENT DOCUMENTS

| | | |
|---|---|---|
| 1,090,731 A | 3/1914 | Lindberg |
| 1,772,179 A | 8/1930 | Finkelstein |

(Continued)

FOREIGN PATENT DOCUMENTS

| | | |
|---|---|---|
| CN | 200987364 | 12/2007 |
| DE | 1674858 | 4/1954 |

(Continued)

OTHER PUBLICATIONS

U.S. Appl. No. 60/720,750, filed Sep. 25, 2005.

(Continued)

*Primary Examiner* — Jila M Mohandesi

(74) *Attorney, Agent, or Firm* — Craig R. Miles; CR MILES P.C.

(57) ABSTRACT

An article of footwear having an upper secured to an outsole in combination having three toe pockets, the first toe pocket having a configuration to separately receive within a big toe of a wearer, and the second toe pocket having a configuration to separately receive within a second toe of the wearer, and the third toe pocket having a configuration to receive within the remaining third toe, fourth toe and fifth toe of the wearer.

12 Claims, 5 Drawing Sheets

Related U.S. Application Data continuation-in-part of application No. 29/406,245, filed on Nov. 10, 2011, now Pat. No. Des. 658,868.

(56) References Cited

U.S. PATENT DOCUMENTS

| | | | | |
|---|---|---|---|---|
| 2,129,226 | A | 9/1936 | Montano | |
| 2,121,907 | A | 6/1938 | Easton | |
| 2,952,082 | A | 9/1960 | Murray | |
| 3,013,564 | A | 12/1961 | Levey | |
| D196,948 | S | 11/1963 | Roman | |
| 3,128,763 | A | 4/1964 | Langenfeld et al. | |
| 3,129,520 | A | 4/1964 | Funk | |
| 3,967,390 | A | 7/1976 | Anfruns | |
| 4,094,081 | A | 6/1978 | Reiner et al. | |
| 4,096,649 | A | 6/1978 | Saurwein et al. | |
| 4,100,685 | A | 7/1978 | Dassler | |
| D259,296 | S | 5/1981 | Meyer | |
| 4,294,022 | A | 10/1981 | Stockli et al. | |
| D278,608 | S | 4/1985 | Thompson | |
| 4,651,354 | A | 3/1987 | Petrey | |
| 4,689,898 | A | 9/1987 | Fahey | |
| D295,114 | S | 4/1988 | Home | |
| 4,827,631 | A | 5/1989 | Thornton et al. | |
| 4,896,438 | A | 1/1990 | DeBasse | |
| 4,907,350 | A | 3/1990 | Chilewich et al. | |
| 4,910,887 | A | 3/1990 | Turner et al. | |
| 4,939,851 | A | 7/1990 | Miller | |
| 4,989,349 | A | 2/1991 | Ellis, III | |
| D321,084 | S | 10/1991 | Miller et al. | |
| 5,063,692 | A | 11/1991 | Suginaka | |
| D321,971 | S | 12/1991 | Bajork | |
| 5,205,071 | A | 4/1993 | Hergenroeder | |
| 5,317,819 | A | 6/1994 | Ellis, III | |
| D349,601 | S | 8/1994 | Buck, IV | |
| 5,384,973 | A | 1/1995 | Lyden | |
| 5,511,323 | A | 4/1996 | Dahlgren | |
| 5,544,429 | A | 8/1996 | Ellis, III | |
| 5,647,145 | A | 7/1997 | Russell et al. | |
| 5,774,898 | A | 7/1998 | Malpee | |
| 5,795,204 | A | 8/1998 | Bruner | |
| 5,815,949 | A | 10/1998 | Sessa et al. | |
| 5,819,439 | A * | 10/1998 | Sanchez | A43B 5/00 36/50.1 |
| 5,913,592 | A | 6/1999 | Moore | |
| 6,016,575 | A | 1/2000 | Prychak | |
| 6,076,283 | A | 6/2000 | Boie | |
| 6,115,940 | A | 9/2000 | Chen | |
| 6,115,941 | A | 9/2000 | Ellis, III | |
| 6,260,288 | B1 | 7/2001 | Barthelemy et al. | |
| 6,282,813 | B1 | 9/2001 | Squadroni | |
| 6,389,711 | B1 | 5/2002 | Polegato | |
| 6,401,364 | B1 | 6/2002 | Burt | |
| 6,430,844 | B1 | 8/2002 | Otis | |
| 6,470,599 | B1 | 10/2002 | Chu | |
| 6,564,475 | B2 | 5/2003 | Collins et al. | |
| 6,637,129 | B2 | 10/2003 | Chen | |
| 6,708,348 | B1 | 3/2004 | Romay | |
| D489,515 | S | 5/2004 | Ganim, II et al. | |
| D492,476 | S | 7/2004 | Sanley | |
| 6,874,252 | B2 | 4/2005 | Nakano | |
| 7,051,457 | B1 | 5/2006 | Huggins et al. | |
| 7,082,703 | B2 | 8/2006 | Greene et al. | |
| 7,107,626 | B1 | 9/2006 | Andrews | |
| 7,310,894 | B1 | 12/2007 | Schwarzman et al. | |
| D579,181 | S | 10/2008 | Swanson et al. | |
| D582,134 | S | 12/2008 | Von Conte et al. | |
| D586,088 | S | 2/2009 | Rubalsky et al. | |
| D586,982 | S | 2/2009 | Fliri | |
| 7,503,130 | B2 | 3/2009 | Helton et al. | |
| 7,707,747 | B2 * | 5/2010 | Nawachi | A43B 7/26 36/55 |
| D622,038 | S | 8/2010 | Bracken | |
| 7,784,115 | B1 | 8/2010 | Nemcik | |
| D625,906 | S | 10/2010 | Zhang | |
| 7,805,860 | B2 | 10/2010 | Fliri | |
| D626,311 | S | 11/2010 | Zhang | |
| D630,005 | S | 1/2011 | Fliri | |
| 7,882,648 | B2 * | 2/2011 | Langvin | A43B 13/12 36/30 R |
| 7,930,841 | B2 * | 4/2011 | Luedecke | A43B 5/08 36/113 |
| D639,535 | S | 6/2011 | Eggert et al. | |
| D640,043 | S | 6/2011 | Buck | |
| 7,971,374 | B2 | 7/2011 | Hernandez | |
| D647,290 | S | 10/2011 | Bramani | |
| D650,977 | S | 12/2011 | Eggert et al. | |
| D658,868 | S | 5/2012 | Chenciner | |
| D668,440 | S | 10/2012 | Chenciner | |
| D670,492 | S | 11/2012 | Chenciner | |
| 2001/0025432 | A1 | 10/2001 | Contreras et al. | |
| 2003/0136023 | A1 | 7/2003 | Chen | |
| 2003/0167653 | A1 | 9/2003 | DeKalb et al. | |
| 2003/0172555 | A1 | 9/2003 | Chu | |
| 2005/0091729 | A1 | 5/2005 | Alley | |
| 2005/0166427 | A1 | 8/2005 | Greene et al. | |
| 2005/0178023 | A1 | 8/2005 | Hammonds | |
| 2005/0229430 | A1 | 10/2005 | Takaba | |
| 2007/0144039 | A1 | 6/2007 | Fliri | |
| 2008/0115386 | A1 | 5/2008 | Geuss | |
| 2008/0156044 | A1 | 7/2008 | Patterson | |
| 2008/0282582 | A1 | 11/2008 | Shapiro | |
| 2009/0113762 | A1 | 5/2009 | Leimer et al. | |
| 2010/0170027 | A1 | 7/2010 | Steel | |
| 2010/0251569 | A1 | 10/2010 | Stern | |
| 2010/0287686 | A1 | 11/2010 | Rosenberg | |
| 2010/0299962 | A1 | 12/2010 | Fliri | |
| 2011/0005105 | A1 | 1/2011 | Hong | |
| 2011/0047825 | A1 | 3/2011 | Young | |
| 2012/0272548 | A1 | 11/2012 | Downard | |

FOREIGN PATENT DOCUMENTS

| | | |
|---|---|---|
| EP | 0152033 | 8/1985 |
| EP | 000037767-0006 | 5/2003 |
| EP | 000382999-0005 | 8/2005 |
| EP | 000382999-0017 | 8/2005 |
| EP | 000664388-0001 | 2/2007 |
| EP | 000731963-0005 | 5/2007 |
| EP | 000943048-0001 | 5/2008 |
| EP | 000943113-0001 | 5/2008 |
| EP | 001008486-0001 | 9/2008 |
| EP | 001008486-0002 | 9/2008 |
| EP | 001101927-0015 | 3/2009 |
| EP | 001101927-0021 | 3/2009 |
| EP | 001101927-0023 | 3/2009 |
| EP | 001101927-0024 | 3/2009 |
| EP | 001101927-0025 | 3/2009 |
| EP | 001101927-0026 | 3/2009 |
| EP | 001101927-0027 | 3/2009 |
| EP | 001158943-0006 | 8/2009 |
| EP | 001158943-0009 | 8/2009 |
| EP | 001158943-0010 | 8/2009 |
| EP | 001158943-0015 | 8/2009 |
| EP | 001158943-0018 | 8/2009 |
| EP | 001158943-0027 | 8/2009 |
| EP | 001158943-0028 | 8/2009 |
| EP | 001158943-0029 | 8/2009 |
| EP | 001158943-0030 | 8/2009 |
| EP | 001725482-0001 | 6/2010 |
| EP | 001725482-0005 | 6/2010 |
| EP | 001725482-0006 | 6/2010 |
| GB | 2249939 | 10/1998 |
| JP | 11032805 | 2/1999 |
| JP | 2002052039 | 2/2002 |
| JP | 2007144075 | 6/2007 |
| JP | 2009019317 | 1/2009 |
| JP | 2010090519 | 4/2010 |
| JP | 2010121227 | 6/2010 |
| JP | 2010285732 | 12/2010 |
| MX | MX/a/2008/004069 | 3/2008 |
| WO | WO/2005/037004 | 4/2005 |
| WO | 2005/074737 | 8/2005 |

(56) References Cited

FOREIGN PATENT DOCUMENTS

| | | |
|---|---|---|
| WO | WO/2007/038293 | 4/2007 |
| WO | WO/2007/038487 | 4/2007 |
| WO | WO/2009/116818 | 3/2009 |

OTHER PUBLICATIONS

U.S. Appl. No. 60/830,922, filed Jul. 15, 2006.
U.S. Appl. No. 12/856,709, filed Aug. 16, 2010.
U.S. Appl. No. 29/380,701, filed Dec. 9, 2010.
U.S. Appl. No. 29/392,337, filed May 19, 2011.
U.S. Appl. No. 29/392,345, filed May 19, 2011.
U.S. Appl. No. 13/206,063.
U.S. Appl. No. 13/247,674, filed Sep. 9, 2011.
Design U.S. Appl. No. 29/406,245, filed Nov. 10, 2011.
Annex to Form PCT/ISA/206 Communication relating to the results of the partial International Search; PCT/US2006/037430, dated 2006.
International Patent Cooperation Treaty Application No. PCT/US2012/035799, filed Apr. 30, 2012.
European Community Design Application No. 2039842, filed May 10, 2012.
Corresponding European Patent Application No. 12847936.7, Office Action dated May 24, 2018, 5 pages.

* cited by examiner

THREE TOED FOOTWEAR

This United States Patent Application is a continuation of U.S. patent application Ser. No. 13/372,414, filed Feb. 13, 2012, now U.S. Pat. No. 8,991,075, issued Mar. 31, 2015, which claims priority of U.S. Design patent application Ser. No. 29/406,245, filed Dec. 10, 2011, now U.S. Design Pat. No. D658,868, issued May 8, 2012, each hereby incorporated by reference herein.

I. FIELD OF THE INVENTION

An article of footwear having an upper secured to an outsole in combination having three toe pockets, the first toe pocket having a configuration to separately receive within a big toe of a wearer, and the second toe pocket having a configuration to separately receive within a second toe of the wearer, and the third toe pocket having a configuration to receive within the remaining third toe, fourth toe and fifth toe of the wearer.

II. BACKGROUND OF THE INVENTION

Typically, footwear having an upper and an outsole in combination providing a toe cap having a structure which receives the five toes of the foot as a group. However, footwear having a toe cap has the disadvantage of requiring all five toes of the foot to move as a group within the footwear even though the big toe is anatomically structured to move independent of the four other toes. This disadvantage has been addressed by a variety of different forms of footwear.

As a first illustrative example, footwear having five toe pockets each having a configuration to correspondingly receive one each of five toes allows independent articulation of each toe within a corresponding toe pocket as described in U.S. Pat. No. 7,805,860. However, footwear having five toe pockets may have the disadvantage of forcing the toes to move independently of each other, even though the four most lateral toes of the human foot share common musculature and tendons and generally move together as one group.

As a second illustrative example, footwear having four toe pockets with the most medial three toe pockets correspondingly structured to receive one each of the big toe and the adjacent two toes and the most lateral of the four toe pockets structured to receive the most lateral two toes of the human as one group is shown in U.S. Design Pat. No. D639,535; however, this structure may not advantage movement of the three most lateral toes of the human foot as one group consistent with the shared musculature and tendons.

As a third illustrative example, footwear having two toe pockets with the most medial first toe pocket correspondingly structured to be received the big toe and the second toe pocket correspondingly structured to receive the remaining four toes of the human foot as group is shown by U.S. Pat. No. 7,971,374. However, the four toes of the human foot located within one toe pocket may be disadvantaged by a loss of prehensility, or loss of grasp between the big toe and the second toe.

Accordingly, there would be an advantage in footwear structured to allow independent articulation of the big toe and the adjacent second toe while maintaining common movement among the remaining three toes.

III. SUMMARY OF THE INVENTION

A broad object of embodiments of the invention can be to provide footwear having an upper secured to an outsole in combination having three toe pockets, the first toe pocket having a configuration to separately receive within the big toe of a wearer, and the second toe pocket having a configuration to separately receive within the second toe (the toe immediately adjacent the big toe) of the wearer, and the third toe pocket having a configuration to receive within the remaining third toe, fourth toe and fifth toe of the wearer. The footwear having three toe pockets provides advantages over other conventional footwear having one, two, four or five separate toe pockets in that the big toe, which moves independently of the other toes, can be received separately in first toe pocket to maintain the natural movement independent of the other toes. Also, the second toe which retains a certain amount of prehensility, or grasping capability can be received within a second toe pocket adjacent the first toe pocket to allow use of prehensility of the second toe in conjunction with the opposed movement of the big toe separate of the remaining three toes. Additionally, a separate third toe pocket allows the third toe, fourth toe and fifth toe to be received as a group within a third toe pocket to facilitate the movement of these toes as a group inside of the footwear, consistent with sharing of the musculature and tendons between these toes, which can be lacking in footwear having individual toe pockets for each toe or may be disadvantaged by footwear having four toe pockets.

Another broad object of embodiments of the invention can be to provide an upper of the footwear that includes as to at least one toe pocket a toe top portion which overlays the top of a toe and a toe side portion which surrounds the toe and which secured to the outsole of the footwear extends upwardly to join the top toe portion. Providing one or more of the tree toe pockets having the form of a toe top portion and toe side portion provides advantages. First, the outsole does not extend substantially upward and does not need to overlay any one of the toes. The outsole can extend upward at the front to a location well below or reside at about the midline of each of the toes allowing the toe side portions of the upper to extending upward to join the corresponding toe top portions. This structure allows each of toes to move forward in the footwear without the toe end being forcibly urged against the inside of the outsole. Rather, the corresponding side toe portion when made from a flexible textile material can stretchably engage one or more toe ends reducing force applied to the toe end without substantial loss of force of the toe downwardly against the outsole. This structure can avoid or reduce injury to the toe end(s) or the corresponding toe nail(s).

Another broad object of embodiments of the invention can be to provide a fluid transfer system in the form of apertures, one or more of which communicate between an insole of the footwear and the outsole of the footwear, which allows fluid inside of the footwear to flow outside of the footwear. A mesh material can interrupt the one or more apertures to prevent ingress of granulated material such as sand from entry into the footwear through the apertures.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
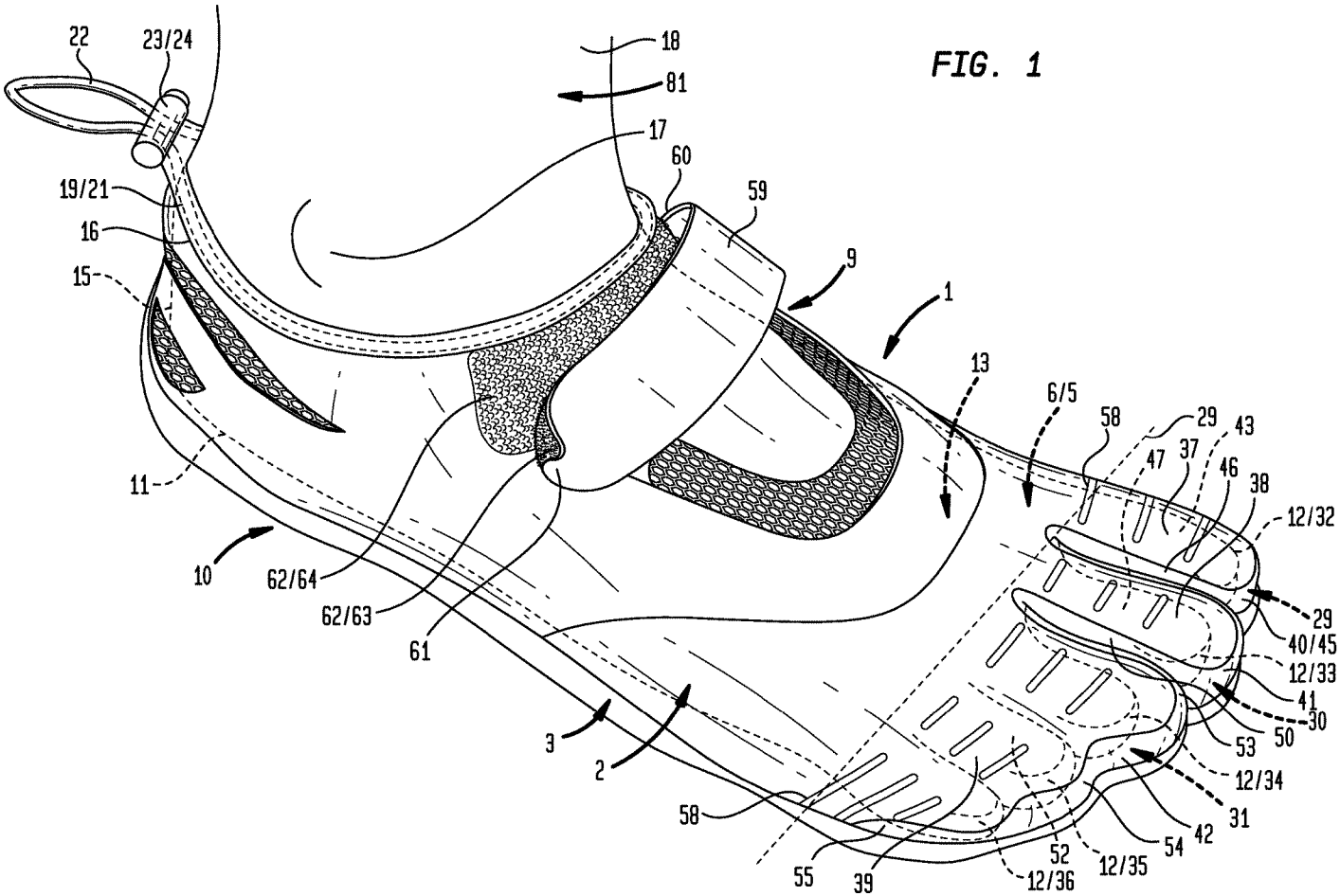
FIG. 1 is a top front perspective view of a particular embodiment of the inventive three toe pocket shoe having inserted within the foot of a wearer (shown in broken line) showing that the first toe inserts into a first toe pocket, the second toe inserts into a second toe pocket, and the third toe, fourth toe and fifth toe all insert into a third pocket.
Figure 2:
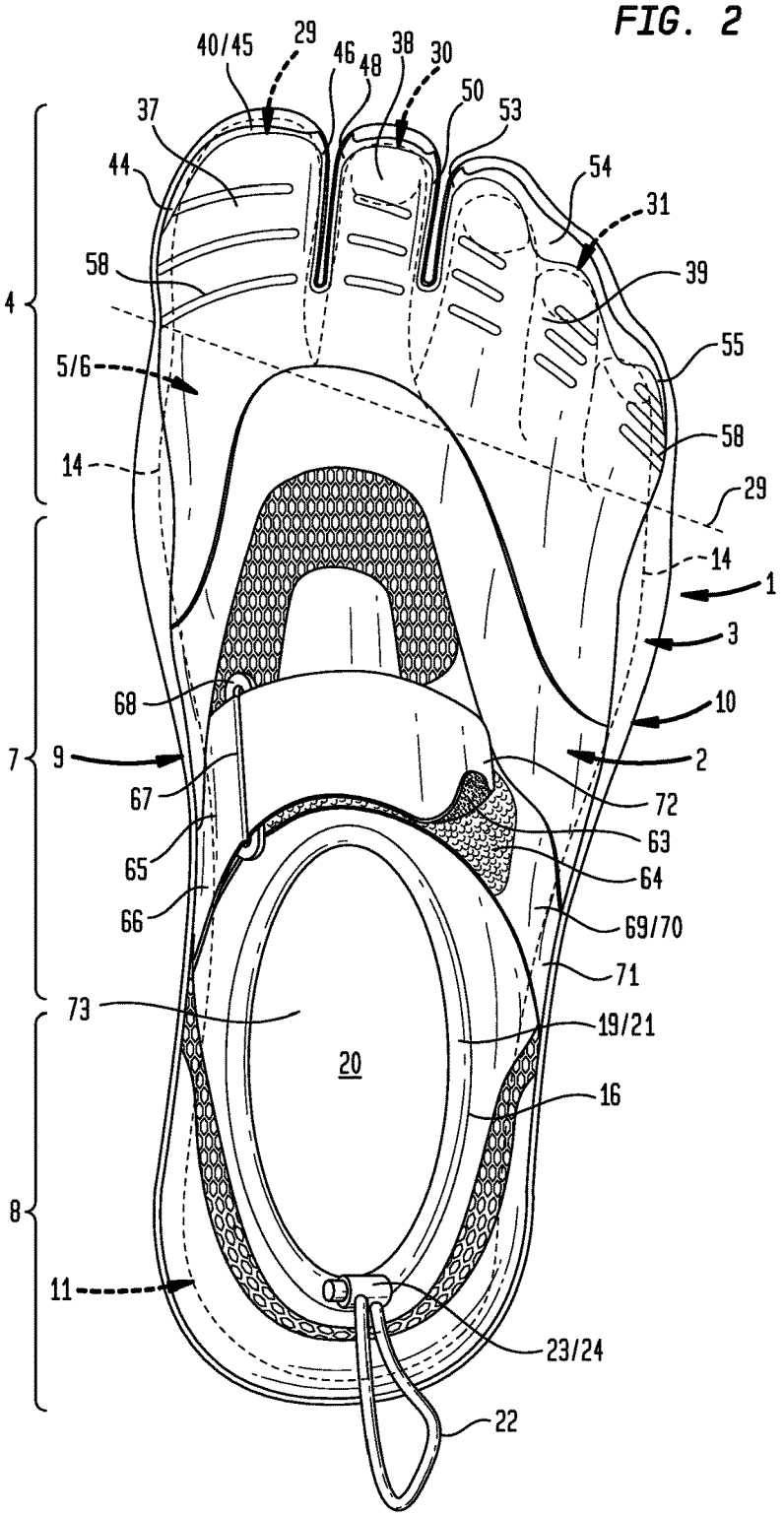
FIG. 2 is a top view a particular embodiment of the inventive three toe pocket shoe having inserted within the foot of a wearer (shown in broken line) showing that the first toe inserts into a first toe pocket, the second toe inserts into a second toe pocket, and the third toe, fourth toe and fifth toe all insert into a third pocket.

Generally, an article of footwear (1) as shown in FIGS. 1 through 5 having an upper (2) secured to an outsole (3), which in combination, defines three general portions of the footwear (1): a forefoot portion (4) configured to receive inside the forefoot (5) of the human foot (6), a midfoot portion (7) configured to receive inside the portion of the human foot (6) between the forefoot (5) and the heel (11) of the human foot (6), and a heel portion (8) configured to receive the heel (11) of the human foot (6)(as shown in the example of FIG. 2)(for clarity leader lines indicating a part of the human foot (6) are shown in broken line). The footwear (1) has a medial side (9) (the inner side) and a lateral side (10) (or outer side). The portions (4)(7)(8) are not intended to demarcate precise areas of the footwear (1), but are intended to represent general areas of the footwear (1) that provide reference for the following description. The footwear (1) as shown in FIG. 1 is disposed substantially horizontally with the lateral side (10) in the foreground, as it would be positioned on a horizontal support surface (not shown) when worn by a wearer (81). However, it is to be appreciated that the footwear (1) need not be limited to such an orientation. The human foot (6) is shown in FIG. 1 and FIG. 2 by broken line inside of the footwear (1) and parts thereof identified by the use of numerical indicators at the end of leader lines rendered in broken line.

Now referring primarily to FIGS. 1 and 2, the footwear (1) includes an upper (2). The upper (2) refers to the part or parts of the footwear (1) that cover the toes (12), the top of the foot (13), the sides of the foot (14), and the back of the heel (15). Depending on the embodiment of the footwear (1) the upper (2) can be cut from a single piece, or a plurality of pieces of material. The heel portion (8) of the upper (2) terminates in a top line (16) which can surround the ankle (17) of the (81) (as shown in the example of FIG. 1) or may extend further up the leg (18) of the wearer (81) depending upon the embodiment. A collar (19) can be joined to the top line (16) of the upper (2). The collar (19) can be made of a stretchable material which conforms to the wearer's (81) foot (6), ankle (17) or leg (18). As to other embodiments, the collar (19) can be releasably adjustable to allow the amount of open area (20) defined by the periphery of the collar (19) (as shown in the example of FIG. 2) to be altered or adjusted by the wearer (81). As shown by the examples of FIGS. 1 and 2, the collar (19) can have a passage (21) configured to receive a cord (22) or drawstring. The drawstring (22) can have adjustable length such that amount of open area (20) defined by the collar (19) can be selected by the wearer (81) by adjusting and fixing the length of the drawstring (22). The length of the drawstring (22) can be fixed by a drawstring fastener (23) which can take any of a wide variety of forms including for example, tied ends of the drawstring (22), or a sliding spring loaded cord clamp (24) (as shown in the examples of FIGS. 1 and 2).

Figure 4:
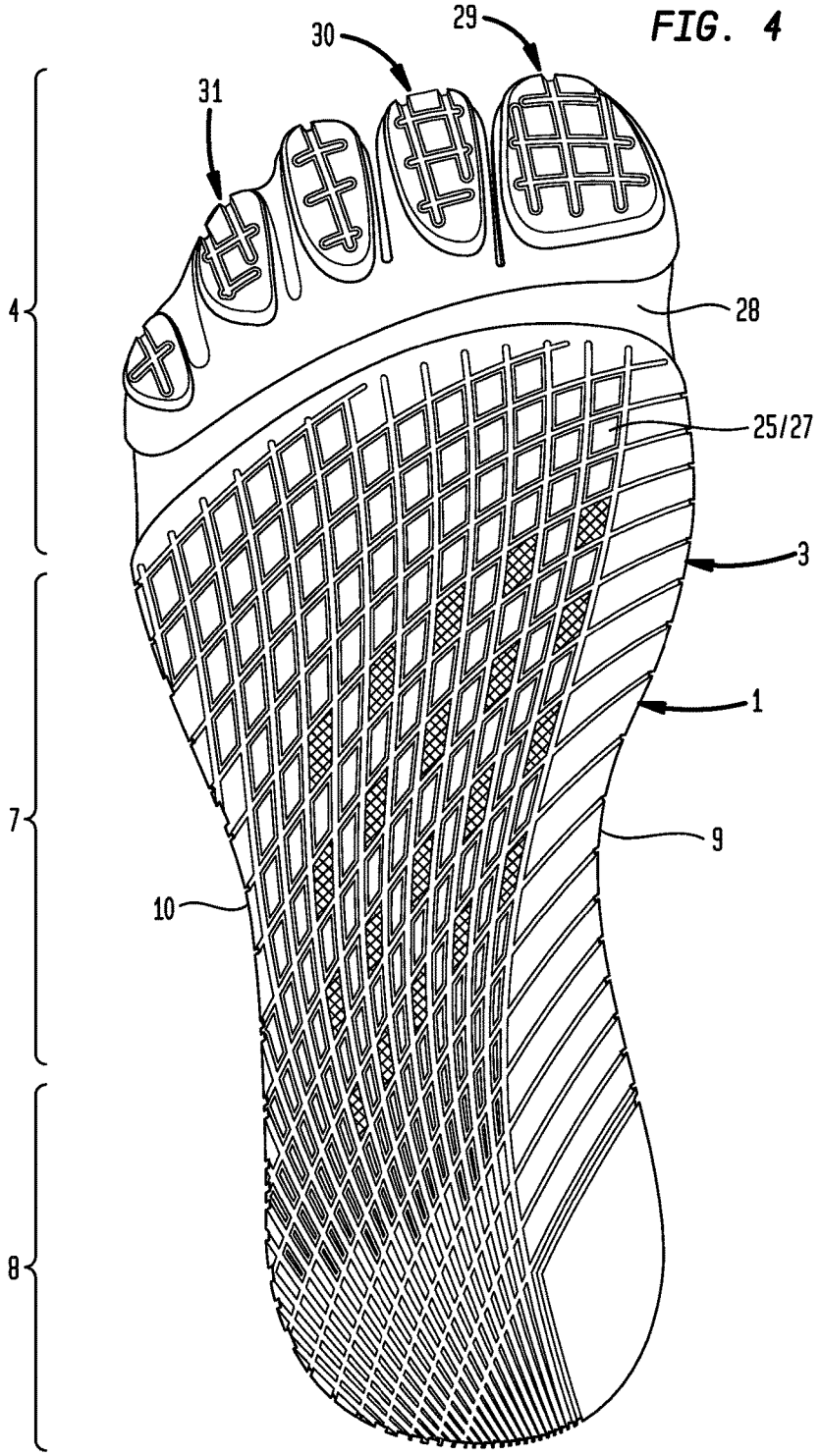
FIG. 4 is a bottom view of a particular embodiment of the inventive three toe pocket shoe which shows the external surface of the outsole and apertures that fluidly couple the external surface of the outsole to the internal surface of the insole to allow passage of fluid from inside the shoe to outside the shoe.

Now referring primarily to FIGS. 1, 2, and 4, the upper (2) can be secured by the periphery to an outsole (3). The outsole (3) (or sole) refers to the part of the footwear (1) that comes into contact with the support surface during normal use. The outsole (3) can be made from one piece from a plurality of pieces. As to certain embodiments the heel portion (8) of outsole (3) may be made of a different material than the midfoot portion (7) or forefoot portion (5). The outsole (3) can be secured to the upper (2) by an adhesive, stitching, or other suitable securement means. The outsole (3) can be made from natural materials such as leather or natural rubber, or from synthetic materials such as styrene butadiene rubber, nitrile-butdiene rubber, polyvinyl chloride, polyurethane, neoprene, polyether, polyester, or the like, or combinations thereof, whether as a solid material or as a foam, thermofoam, closed cell foam, or layers or combinations thereof.

Now referring primarily to FIG. 4, a raised tread pattern (25) demarcated by tread grooves (26) can extend over substantially the whole of the bottom of the outsole (3). While the invention is not limited to any particular raised tread pattern (25) and particular embodiments may be without any raised tread pattern (25), the raised tread pattern (25) can take the form of a crosshatch (27) (as shown in the example of FIG. 4). The outsole (3) can further provide one or more flex groove(s) (28) which can extend partially across or extend substantially across the entire width of the outsole (3) between the medial side (9) and lateral side (10) of the footwear (1). As shown by the example of FIG. 4, the flex groove (28) can be generally aligned with the joint line (29) of the medial metatarsal phalanges of the foot (6) (as shown in the example of FIG. 1) to enhance flexibility of the outsole (3) at a location which aids in natural foot motion.

Again referring primarily to FIGS. 1 and 2, the upper (1) secured to the outsole (3) in combination can have three toe pockets (29)(30)(31). The first toe pocket (29) has a configuration to separately receive inside a first toe (32) of the wearer (81). The first toe (32) being the most medial toe of the foot (6) (also referred to as the "big toe" or "hallux"). The second toe pocket (30) has a configuration to separately receive inside a second toe (33) of the wearer (81). The second toe (33) being the located next to the first toe (32) (also referred to as the "long toe"). The third toe pocket (31) has a configuration to receive inside the remaining third toe (34), fourth toe (35) and fifth toe (36) (also referred to as the "little toe" and being most distal from the first toe (32)).

There can be an advantage in providing three toe pockets (29)(30)(31) as above-described. First, the big toe (31) is primarily flexed by the flexor hallucis longus muscle, located in the deep posterior of the lower leg (18), via the flexor hallucis longus tendon. Additional flexion control is provided by the flexor hallucis brevis. It is extended by the abductor hallucis muscle and the adductor hallucis muscle. The big toe (31) can be moved independently of the remaining or other toes (33)(34)(35)(36). Therefore, a separate first toe pocket (29) allows the first toe (32) (the "big toe") to be separately received within the footwear (1) to maintain movement in a toe which naturally moves independently of the other toes (33)(34)(35)(36). As to the second toe (33), third toe (34), fourth toe (35) and fifth toe (36) the flexor digitorum brevis muscle and the extensor digitorum brevis muscle and the flexor tendons are shared, making these toes (33)(34)(35)(36) generally move as one unit. However, some prehensility, or grasping capability, in these toes still exists. Second, providing a separate second toe pocket (30) allows the second toe (33) to be separately received with in the footwear (1) to allow use of prehensility of the second toe (33) in conjunction with the opposed movement of the first toe (32) separate of the remaining three toes (34)(35)(36). Third, providing a separate third toe pocket (31) allows the third toe (34), fourth toe (35) and fifth toe (26) to be received as a group within one toe pocket to facilitate the movement of these toes (34)(35)(36) as a group inside of the footwear (1), consistent with sharing of the musculature and tendons, as above-described, which is lacking in footwear having individual toe pockets for each toe or may be disadvantaged by footwear having four toe pockets.

Again referring primarily to FIGS. 1 and 2, as to particular embodiments, the upper (2) of at least one of the three toe pockets (29)(30)(31) can include a toe top portion (37)(38)(39) in combination with a toe side portion (40)(41)(42). As to these embodiments, the toe side portions (40)(41)(42) can be secured to the outsole (3) and extend upwardly to correspondingly connect to the toe top portions (37)(38)(39). Now referring to the example provided by FIG. 1, the first toe pocket (29) can have a first toe top portion (37) configured to generally overlay the top (43) of the first toe (32) received inside of the first toe pocket (29) and a first toe side portion (40) which surrounds the medial side (44), front side (45) and lateral side (46) of the first toe pocket (29). Similarly, the second toe pocket (30) can have a second top toe portion (38) of the upper (2) which generally overlays the top (47) of the second toe (33) received inside of the second toe pocket (30) and a corresponding second toe side portion (41) that surrounds the medial side (48), front side (49) and lateral side (50) of the second toe pocket (30). Again, similarly, the third toe pocket (31) can have a third top toe portion (51) of the upper (2) which generally overlays the top (52) of the third toe (34), fourth toe (35), and fifth toe (36) received inside of the third toe pocket (31) and a corresponding third toe side portion (42) that surrounds the medial side (53), front side (54) and lateral side (55) of the third toe pocket (31).

Providing one or more of the tree toe pockets (29)(30)(31) having the form of a toe top portion (37)(38)(39) and toe side portion (40)(41)(42) provides certain advantages. First, the outsole (3) does not need to extend substantially upward and does not need to overlay any one of the toes (32)(33)(34)(35)(36). The outsole (3) can extend upward at the front well below or reside at about the midline of each of the toes (32)(33)(34)(35)(36) with the toe side portions (40)(41)(42) of the upper (2) extending upward to join the corresponding toe top portions (37)(38)(39). This structure allows each of toes (32)(33)(34)(35)(36) to move forward in the footwear (11) without the toe end (56) being forcibly urged against the inside of the outsole (3). Rather, the corresponding side toe portion (40)(41)(42) when made from a flexible textile material can stretchably engage one or more toe ends (56) reducing force applied to the toe end (56) without substantial loss of force of the toe downwardly against the outsole (3). This structure can avoid or reduce injury to the toe end(s) (56) or the corresponding toe nail(s) (57).

Again referring primarily to FIGS. 1 and 2, one or more of the three toe pockets (29)(30)(31) can further include one or more flex elements (58) disposed in the flexible textile material of one or more of the top toe portions (37)(38)(39) of the upper (2) which can extend partially across or extend substantially across the entire width of the top toe portion (37)(38)(39) between the medial side and lateral side of the each corresponding toe pockets (29)(30)(31). The one or more flex elements (58) allows the top toe portion (37)(38)(39) of the upper (2) to flex more readily upon flexure of the outsole (3).

Again referring primarily to FIGS. 1 and 2, embodiments of the footwear (1) can further include a releasably securable strap (59) extending over the upper (2), a first end (60) of the strap (59) being secured to a medial side (9) of the upper (2) and a second end (61) of the strap (59) releasably secures to a lateral side (10) of the upper (2). Releasable securement of the strap (59) can be in the form of mated halves of a strap fastener (62) whether mechanical or by the matable surfaces of a hook material (63) with a loop material (64)(as shown in the example of FIG. 1). As to other embodiments, the releasably secured strap (59) can include a first portion (65) having a first end (66) and a second end (67) with the first end (66) secured to the medial side (9) of the upper (2). A ring (68) (whether elongate as shown in the example of FIG. 2 or other configuration such as a d-ring or circular ring) can be coupled to the second end (67) of said first portion (65). A second portion (69) can have a medial portion (70) disposed between a first end (71) and a second end (72) with the first end (71) being secured to the lateral side (10) of the upper (2). The second portion (69) can extend through the ring (68) and the second end (72) can releasably secured to the medial portion (70) of the second portion (69). Understandably, other forms of a releasably securable strap (59) can be utilized with embodiments of the footwear (11).

Figure 3:
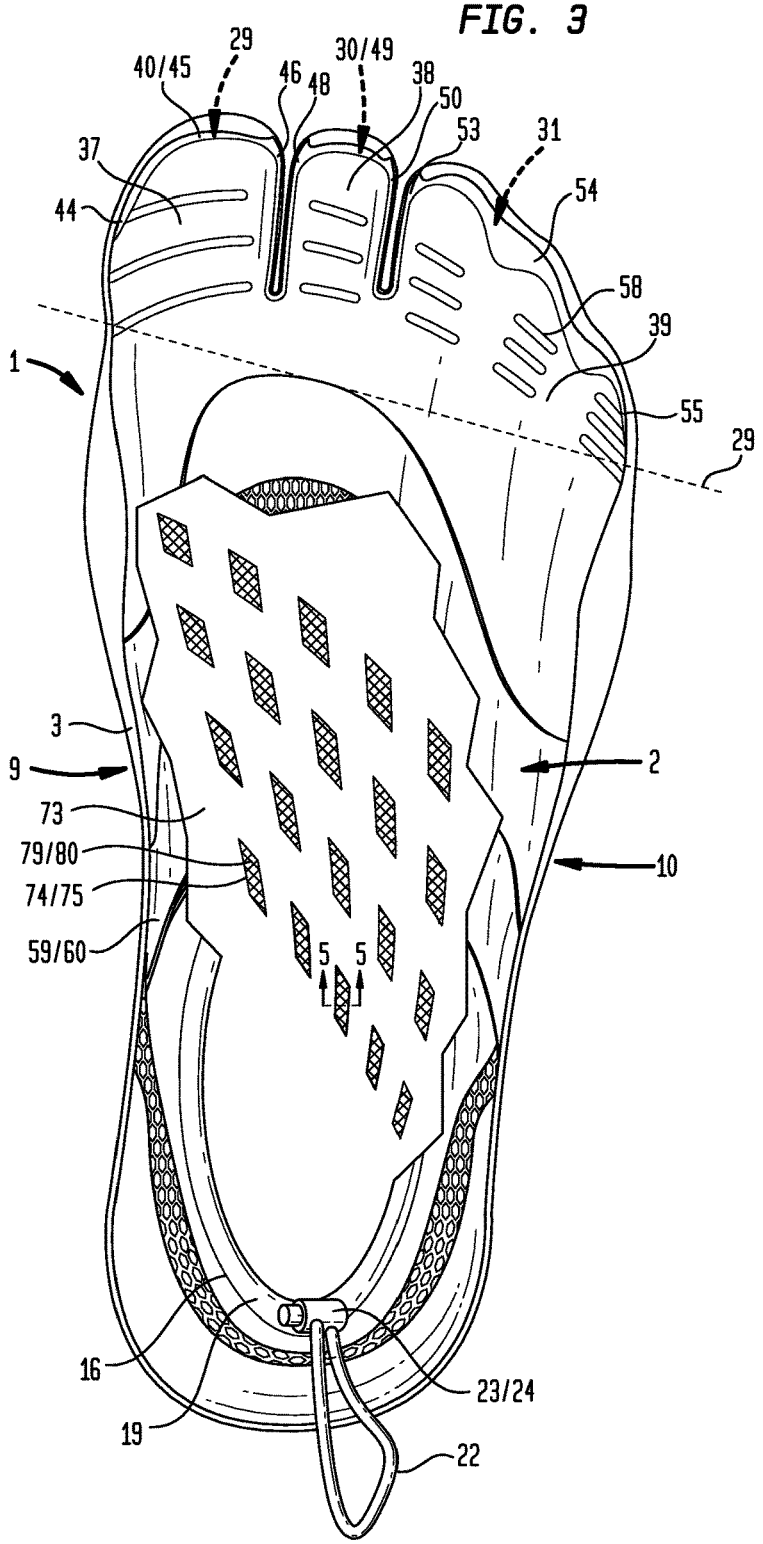
FIG. 3 is a top view of a particular embodiment of the inventive three toe pocket shoe having a portion of the vamp or upper part removed to show the drainage system which provides apertures that fluidly couple the internal surface of the insole with the external surface of the outsole to allow passage of fluid from inside the shoe to outside the shoe.
Figure 5:
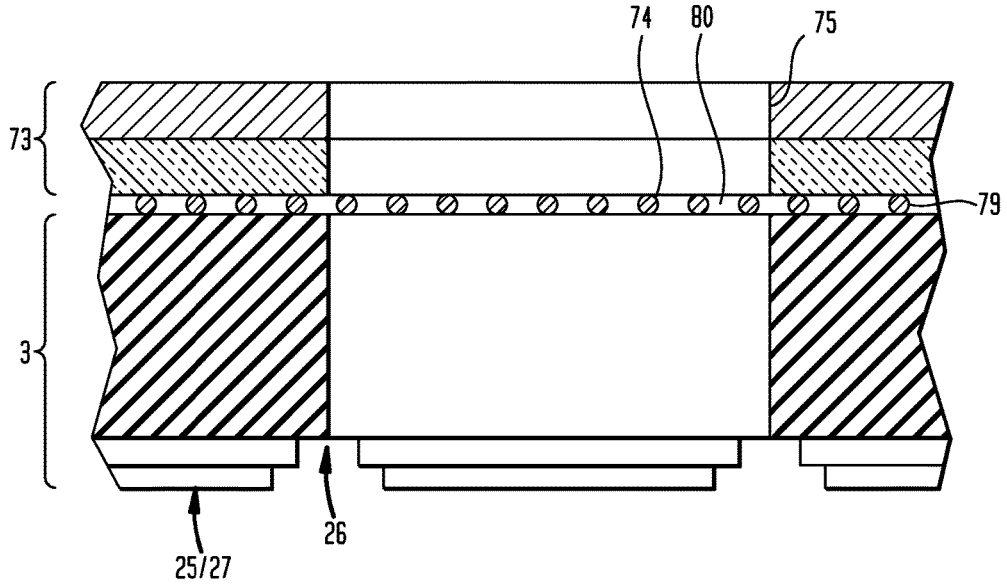
FIG. 5 is an enlarged view of cross section 5-5 shown in FIG. 3.

Now referring primarily to FIGS. 3, 4 and 5, embodiments of the footwear (1) can include an insole (73) secured to the outsole (3) in combination having at least one aperture (74) which fluidly communicates between inside of said footwear (1) and the outside of the footwear (11). As shown in FIGS. 3 and 4, the at least one aperture (74) can be a plurality of apertures (74) generally located in the midfoot portion (7) of the footwear (1). While the invention is not so limited, one or more or all of the plurality of apertures (74) can generally be in the form of a parallelogram (75), each parallelogram (75) having a first pair of opposed angles (76) and a second pair of opposed angles (77), the first pair of opposed angles (76) of lesser degree angle (78) than said second pair of opposed angles (77). A mesh material (79) can be disposed between the outsole (3) and said insole (73). The mesh material (79) can have mesh openings (80) sufficient in area to allow an amount of fluid to pass through one or more of the plurality of apertures (74), but sufficiently small in area to exclude the passage of granulated material, such as gravel or sand. As to particular embodiments, the mesh openings (80) can be generally square form having a sieve size in a range of between about 0.5 millimeters and about 1.0 millimeters. The term "fluid" means any substance whether solid or gas flowable through one or more of the apertures. For example, the term "fluid" encompasses, without limitation to the broad scope of the definition: atmospheric gases, water, particles sufficiently fine to pass through the mesh openings (80).

Now referring primarily to FIGS. 1 and 2, which show a method of using embodiments of the inventive footwear (1), a wearer (81) can insert a foot (6) inside of an upper (2) secured to an outsole (3), in combination having three toe pockets (29)(30)(31). The wearer (81) can locate a first toe (32) separately in the first toe pocket (29) and locate the second toe (33) separately in a second toe pocket (30). The wearer (81) can locate the remaining three toes (34)(35)(36) (third toe, fourth toe and fifth toe) in the third toe pocket (31). As to particular embodiments, at least one of the three toe pockets (29)(30)(31) can have the upper (2) including a top toe portion (37)(38)(39) and a corresponding side toe portion (40)(41)(42) and the wearer (11) can locate the toes (32)(33)(34)(35)(36) in the corresponding one of the three toe pockets (29)(30)(31) such that the corresponding top toe portions (37)(38)(39) generally overlay a top (43)(47) of each toe (12) and the toe side portions (40)(42)(43) generally surrounds the toe (12) or toes received inside of toe pocket (29)(30)(31).

As to certain embodiments the footwear (1) can be secured about the wearer's (81) foot (6). For example, the wearer (81) can releasably secure a strap (59) extending over the upper (2). The first end (60) of the strap (59) being secured to a medial side (9) of the upper (2) and the second end (61) of the strap (59) being releasably secured by the wearer (11) to a lateral side (10) of the upper (2) by a strap fastener (62). As to certain embodiments, the wearer (11) can engage the matable portions of a loop material (64) coupled to the lateral side (10) of the upper (2) to a hook material (63) coupled proximate the second end (67) of the strap (59); however, it is appreciated that the strap fastener (62) can take many different forms.

As to other embodiments, the wearer (81) can releasably secure an embodiment of the strap (59) which includes a first portion (65) secured by a first end (66) to the medial side (9) of the footwear (1). The ring (68) as above described can be secured to second end (67) of the first portion (65). A second portion (69) having a medial portion (70) disposed between a first end (71) and a second end (72) can have the first end (71) secured to the lateral side (10) of the upper (2). The wearer (11) can pass the second end (72) through the ring (68) and releasably secure the second end (72) to the medial portion (70) of said second portion (69) by mated engagement of the parts of the strap fastener (62), which as to certain embodiments can be mated hook an loop materials (63)(64).

As to other embodiments, the wearer (81) locate the collar (19) coupled to the top line (16) of the upper (3) to surround the leg (18), which as to certain embodiments can be below the ankle (17), at the ankle (17) or above the ankle (17). As to those embodiments of the collar (19) which are elastically stretchable, the collar (19) can elastically engage the portion of the leg (18) and re-conform to the leg (18) as it moves. As to other embodiments, as shown in the example of FIG. 1, the wearer (11) can adjust the amount of open area (20) defined by the collar (19) joined to the top line (16) of the upper (2) by adjusting the length of a drawstring (22) located inside of a passage (21) within the collar (19).

The method of using the footwear (1) can further include transfer of an amount of fluid from inside the footwear (1) to outside of the footwear (1) through at least one aperture (74) fluidly communicating between surfaces of the insole (73) secured in combination to the outsole (3).

As can be easily understood from the foregoing, the basic concepts of the present invention may be embodied in a variety of ways. The invention involves numerous and varied embodiments of an inventive passive chamber spark plug including devices and methods for using such devices including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "flex element" should be understood to encompass disclosure of the act of "flexing"—whether explicitly discussed or not—and, conversely, were there effectively disclosure of the act of "flexing", such a disclosure should be understood to encompass disclosure of a "flex element" and even a "means for flexing." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each footwear herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. An article of footwear, comprising an upper secured to an outsole in combination to delimit only three discrete toe pockets, each one of said three toe pockets having medial and lateral toe pocket side portions and a toe pocket front portion secured to said outsole, each upwardly extending to connect to a corresponding toe pocket top portion, wherein a first toe pocket closest to a medial side of said article of footwear delimits an individual toe pocket configured to receive within only a big toe of a wearer, and wherein a second toe pocket disposed immediately adjacent said first toe pocket delimits an individual toe pocket configured to receive within only a second toe disposed immediately adjacent said big toe of said wearer, said second toe pocket having a lesser width across said toe pocket top portion than said first toe pocket, and wherein a third toe pocket disposed immediately adjacent said second toe pocket and closest a lateral side of said article of footwear delimits an individual toe pocket configured to receive within only the remaining third toe, fourth toe and fifth toe of said wearer, said third toe pocket having a greater width across said toe pocket top portion than either of said first or second toe pockets.

2. The article of footwear of claim 1 wherein said toe top portion and said toe side portion comprise a flexible textile material.

3. The article of footwear of claim 2, wherein said flexible textile material of said top toe portion further comprises one or more flex elements along which said flexible textile flexes upon flexure of said outsole.

4. The article of footwear of claim 1, further comprising a releasable strap extending over the upper, a first end of said strap being secured to a medial side of said upper and a second end of the strap releasably secures to a lateral side of said upper.

5. The article of footwear of claim 1, wherein said releasable strap comprises:

a) a first portion having a first end and a second end, said first end secured to a medial side of said upper;

b) a ring coupled to said second end of said first portion; and c) a second portion having a medial portion disposed between a first end and a second end, said first end being secured to said lateral side of said upper, said second portion extending through the ring and said second end releasably securable to said medial portion of said second portion.

6. The article of footwear of claim 1, further comprising a collar joined to a top line of said upper, said collar releasably adjustable to alter an amount of open area defined by said collar.

7. The article of footwear of claim 6, wherein said collar has a passage configured to receive a drawstring, said drawstring having adjustable length to alter said amount of open area defined by said collar.

8. The article of footwear of claim 1, further comprising:

a) an insole secured to said outsole in combination having at least one aperture which fluidly communicates between inside of and outside of said article of footwear; and b) a mesh material disposed between said outsole and said insole, said mesh material having mesh openings sufficient in area to allow an amount of fluid to pass through said at least one aperture.

9. The article of footwear of claim 8, wherein said at least one aperture comprises a plurality of apertures.

10. The article of footwear of claim 9, wherein said plurality of apertures have a location generally within the instep of said outsole.

11. The article of footwear of claim 10, wherein said mesh openings have a generally square form having a sieve size in a range of between about 0.5 millimeters and about 1.0 millimeters.

12. The article of footwear of claim 11, wherein said plurality of apertures each generally have the form of a parallelogram, each parallelogram having a first pair of opposed angles and a second pair of opposed angles, said first pair of opposed angles of lesser degree angle than said second pair of opposed angles.

* * * * *